US005515786A

United States Patent [19]

Schilling et al.

[11] Patent Number: 5,515,786

[45] Date of Patent: May 14, 1996

[54] PROJECTILES FOR ATTACKING HARD TARGETS AND METHOD FOR CONTROLLING INITIATION OF A PROJECTILE

[75] Inventors: Michel Schilling, Chateauneuf sur Cher; Jean-Gabriel Misse, Saint Florent sur Cher; Bruno Lang, Bourges, all of France

[73] Assignee: Luchaire Défense SA, Versailles, France

[21] Appl. No.: 417,893

[22] Filed: Apr. 6, 1995

[30] Foreign Application Priority Data

Apr. 15, 1994 [FR] France ..... 94 04528

[51] Int. Cl.[6] ..... F42B 12/16

[52] U.S. Cl. ..... 102/476; 102/266; 102/397; 102/500

[58] Field of Search ..... 102/306–310, 102/216, 265, 266, 476, 473, 499, 500, 382, 389, 396, 397

[56] References Cited

U.S. PATENT DOCUMENTS

| | | | |
|---|---|---|---|
| 2,728,296 | 12/1955 | Meister | 102/476 |
| 3,633,510 | 1/1972 | Bernardin | 102/476 |
| 4,462,312 | 7/1984 | Cahannes et al. | 102/473 |
| 4,463,678 | 8/1984 | Weimer et al. | 102/476 |
| 4,606,272 | 8/1986 | Kerdraon . | |
| 4,831,936 | 5/1989 | Brattstrom et al. | 102/476 |
| 4,913,057 | 4/1990 | Kropp et al. | 102/476 |
| 5,121,691 | 6/1992 | Nicolas | 102/364 |
| 5,309,843 | 5/1994 | Rentzsch et al. . | |

FOREIGN PATENT DOCUMENTS

| | | | |
|---|---|---|---|
| 0217770 | 4/1987 | European Pat. Off. . | |
| 391876 | 10/1990 | European Pat. Off. | 102/476 |
| 0433254 | 6/1991 | European Pat. Off. . | |
| 0154580 | 9/1985 | France . | |
| 3800976 | 7/1989 | Germany . | |
| 3800975 | 7/1989 | Germany | 102/476 |
| 4225704 | 2/1994 | Germany . | |
| WO90/12271 | 10/1990 | WIPO | 102/476 |

OTHER PUBLICATIONS

*Hanbook on Weaponry,* Second English Edition, Rheinmetall, 1982 pp. 525,526.

*Primary Examiner*—Harold J. Tudor
*Attorney, Agent, or Firm*—Oliff & Berridge

[57] ABSTRACT

A projectile includes an explosive charge, a corresponding initiating device, a penetrator that only deforms upon impact with a target having a predetermined mechanical resistance, an internal impact contactor arranged between the penetrator and the charge, and a device to ensure initiation of the charge following crushing of the internal impact contactor and after the explosive charge has begun to be deformed following impact on the target. The projectile is particularly effective against hard targets such as stone, brick or cement structures.

20 Claims, 3 Drawing Sheets

PROJECTILES FOR ATTACKING HARD TARGETS AND METHOD FOR CONTROLLING INITIATION OF A PROJECTILE

BACKGROUND OF THE INVENTION

The scope of the present invention is that of projectiles designed to attack hard constructions of the type comprising structures made of, for example, stone, brick, cement or other building materials.

Such targets are usually reserved for engineering teams who are entrusted with the task of placing explosives directly onto the construction.

However, from a tactical point of view, such operations are difficult to perform.

Research has been undertaken in order to design projectiles that may be fired from a safe distance and are able to cause significant damage to such targets.

However, the targets are, more often than not, protected by a substantially deep layer of sand bags that cause the initiation of common explosive charges at a distance from the stone or cement construction that is too great for any great damage to be caused to the construction.

Projectiles having devices for distinguishing targets according to their hardness are known elsewhere.

Patent EP433254 thus describes a projectile having a double contactor in the nose cone. A first contact is closed during the impact on a "soft" target, such as an aircraft or light vehicle. The first contact causes the charge to be initiated after a certain delay, that is to say when the projectile finds itself more or less inside the target.

A second contact is closed during the impact on a "hard" target, that is to say a target that the projectile can not pierce. The second contact causes the instant initiation of the explosive charge.

Such a projectile is able to tell the difference between a "soft" target such as a light vehicle or an aircraft and a "hard" target such as a tank, but it remains ineffective against targets of the building or extra-protected "hot" caves.

In fact, the hardness of impact on extra-protections such as sand bags causes the instant initiation of the charge at a distance from the building construction that is too great to cause the building any damage.

SUMMARY OF THE INVENTION

A first aim of the invention is to propose a projectile of a simple design that is effective against hard targets such as buildings or "hot" caves, even those equipped with extra peripheral protection.

To this end, the projectile proposed by the invention is able to penetrate peripheral protections such as sand bags in order to bring the explosive charge into direct contact with the hard construction and thereby initiate it.

A further aim of the invention is to propose a projectile such that it will also be relatively effective against armored targets (such as tanks) and also against light targets (such as light vehicles or aircraft).

Thus, the subject of the invention is a projectile designed to attack hard targets such as stone, brick or cement structures. The projectile comprises an explosive charge and initiating structure for the explosive charge, a projectile characterised in that it comprises a penetrator, which only deforms upon impact with a target having a given minimum mechanical resistance, and an internal impact contactor arranged between the penetrator and the charge, a projectile having structure to ensure the initiation of the charge further to the crushing of the internal contactor and after the explosive charge has begun to be deformed following impact on the target.

The invention therefore combines piercing structure (the penetrator), which ensures the penetration of the projectile through any possible extra-protections, and initiation structure for the charge that causes functioning of the "squash-head" type (initiation after crushing of the charge) upon contact with the construction.

Such a combination makes the projectile much more effective against structures than conventional projectiles.

According to another characteristic, the explosive charge may be a shaped charge comprising a concave shell in contact with an explosive material and creating a cavity.

Such a characteristic increases the projectile's effectiveness against structures and enables it to be given an anti-tank functioning mode.

According to one embodiment, the internal contactor may be arranged in the cavity demarcated by the shell, in such a way that the contactor may only be closed after the charge has begun to be deformed after impacting on a target.

According to a different embodiment, the structure ensuring the initiation of the charge may comprise a first delay activated by the internal contactor.

According to an alternative embodiment, the explosive charge may comprise as least one explosive material giving a blast effect upon initiation, for example an Aluminum powder.

A mixture of Hexogen and aluminium powder in the following general proportions: Hexogen 70% to 90%, Aluminum 30% to 10%, may, for example, be chosen as an explosive material.

According to another embodiment of the invention, the projectile may be fitted with a ballistic nose cone arranged in front of the penetrator and bearing an electrical contact activated upon impact on the target.

The projectile may comprise, with advantage, a firing mode selector enabling either initiation further to the closing of the internal contactor or initiation further to the closing of the nose cone contact to be selected.

In this event, when the selector is positioned in such a way as to choose the nose contact, the crushing of the nose cone upon impact on the target will cause the instant initiation of the charge.

When the selector is positioned so as to choose the internal contactor, the crushing of the nose cone contact may, with advantage, cause the initiation of the charge using a second delay.

BRIEF DESCRIPTION OF THE DRAWINGS

The invention will be better understood after reading the following description of the different embodiments of the invention made with reference to the appended drawing in which.

DETAILED DESCRIPTION OF PREFERRED EMBODIMENTS

Figure 1:
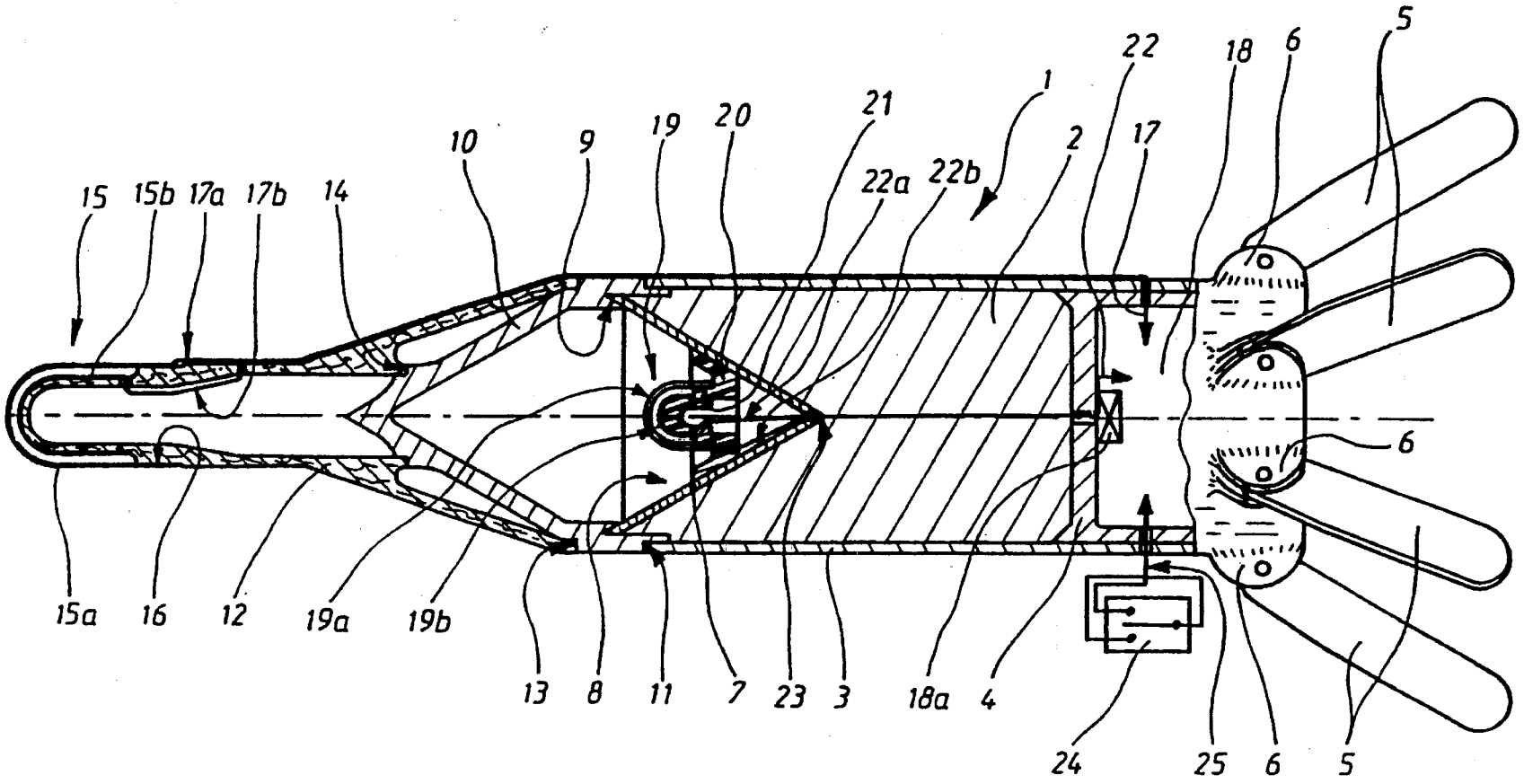
FIG. 1 shows a cross-section of a projectile according to a first embodiment of the invention.

Referring to FIG. 1, a projectile 1 according to the invention comprises an explosive charge 2 arranged inside a cylindrical case 3 made of a light alloy, for example aluminum.

The case 3 is closed off at the rear by a bottom 4 bearing stabilization fins 5 evenly distributed at an angle. The fins are jointed onto fork joints 6 carried by the bottom 4 and spread out when the projectile is fired from a recoilless launch tube of a known type (not shown).

The explosive charge 3 is a shaped charge comprising a concave shell 7 in contact with an explosive material. The shell demarcates a cavity 8 that has, for example a conical shape.

The explosive material will be chosen in such a way as to create a reinforced blast effect upon its initiation. This effect increases the shock wave to the outer walls of cement constructions upon initiation which helps to crack the outer walls. Such an explosive material also enables an incendiary effect to be given to the rear of targets of the armored or lightly-armored vehicle type.

An explosive comprises a finely divided reducing agent, such as a metallic powder and preferably an aluminum powder.

Hexal, i.e., a mixture of Hexogen and aluminum powder is effective and may be used in the following general proportions: Hexogen 70% to 90%, Aluminium 30% to 10%.

The explosive may be pressed into the case 3 fitted with its shell or the explosive may be machined to its final size and bonded to the case.

It would also be possible to use other types of explosives such as composite explosives having an agent designed to reinforce the blast effect.

The shell is made of a flexible material (for example copper), a material which is likely to deform in such as way as to form a shaped linear charge upon initiation of the explosive.

The shell rests upon a conical support 9 arranged on a penetrator 10.

The conical support 9 enables the shell and the explosive charge to be held on during the massive deceleration that occurs upon impact on the sand bags.

The penetrator 10 is made of a material that is resistant to impact, for example aluminum.

It has a streamlined outer shape which facilitates penetration of light extra-protections (partition walls, sand bags).

The profile of the penetrator is expertly designed so as to be able to penetrate the sand bags and other light protections without becoming deformed. This profile is also designed so as not to resist impact on a hard construction such as cement or stone.

The penetrator 10 has a shoulder 11 upon which the case 3 comes to rest. The case 3 is fastened to the penetrator 10 by bonding. Another fastening means could be employed such as, for example, radial pins or screwing.

The projectile 1 also comprises a ballistic nose cone 12 made of a light material, for example, a fiber-glass composite, bonded to the penetrator 10. The cone is designed to give a streamlined profile to the projectile so as to reduce loss of velocity during its ballistic trajectory.

The cone 12 comes to rest on the penetrator 10 on two shoulders, a rear shoulder 13 and a front shoulder 14.

On its front part the cone 12 carries an electrical contact 15 having, in a conventional manner, a light metal cap **15*a* made, for example, of brass, that is bonded to a support 16 of the cone, and a metal coating 15*b* deposited on the front part of the cone. The contacts 15*a* and 15*b* are connected by conductors 17*a* and 17*b* to an initiating means 18 of the explosive charge. The initiating means is placed in the bottom 4 and substantially comprises an initiator 18*a***.

The conductors **17*a* and 17*b* may, for example, be bonded to the outer surface of the projectile 1**.

The projectile 1 lastly comprises an internal contactor 19 that is placed inside the cavity 8 demarcated by the shell 7.

The contactor comprises a support 20 made of an insulating material (for example a plastic or composite material) having a conical outer profile and that is bonded onto the shell 7. The support 20 has been electroplated on its central part **19*b* and has a light metal cap 19*a* bonded to the bearing surface 21 of the support 20**.

Contacts **19*a* and 19*b* are connected to the initiating means 18 by conductors 22*a* and 22*b*. The conductors 22*a* and 22*b* must pass through the charge in such a place that they are not cut or destroyed before closing the contact The conductors 22*a* and 22*b*** therefore should be placed to the rear of the contactor with respect to the projectile's line of action.

To this end, the conductors **22*a* and 22*b* pass through the shell 7 via an axial hole 23 and also pass through the explosive material of the charge 2** in a roughly axial direction.

The effect of installing the internal contactor 19 inside the cavity 8 demarcated by the shell 7 is to prevent the contactor from closing before the charge has begun to be deformed further to its impact on a target.

Figure 2:
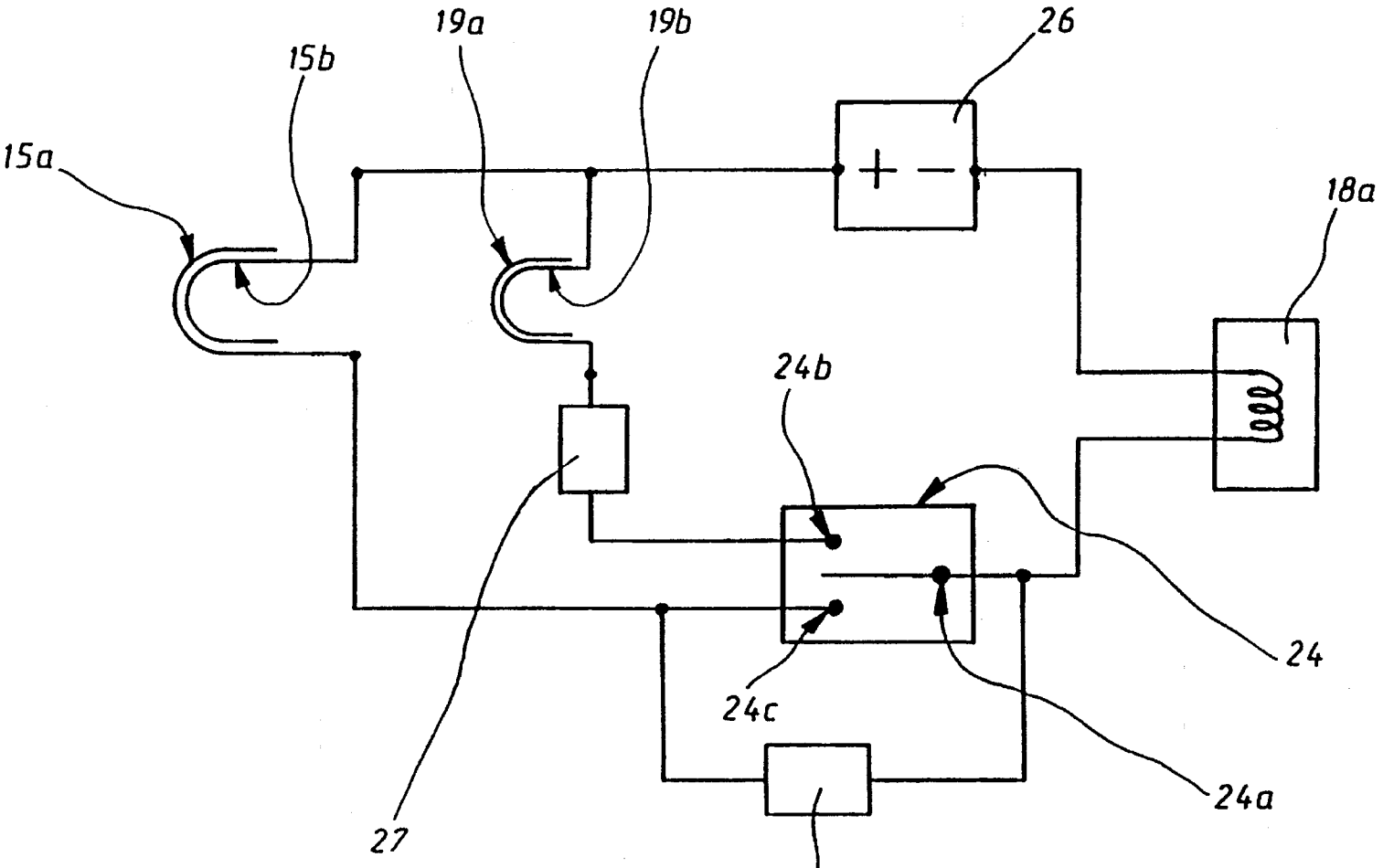
FIG. 2 is a diagram describing the structure of the initiation strucute of the projectile according to the invention.

FIG. 2 shows a diagram of the initiating means **18*a*** of the projectile according to the invention.

The initiating means comprises a firing mode selector 24 that is preferably arranged outside the projectile and is connected to the projectiles by conductors 25 (see FIG. 1). The selection 24 will be mounted, for example, on the barrel of the weapon.

The selector 24 enables the selection of either an "anti-construction" mode (in which contacts **24*a* and 24*b* are connected) and a "anti-armor" mode (in which contacts 24*a* and 24*c*** are connected).

The "anti-construction" mode corresponds to the choice to initiate the explosive charge further to the closing of the internal contactor 19.

The anti-armor mode corresponds to the choice to initiate the explosive charge further to the closing of the cone contact 15.

The initiation means 18 comprises a source of energy 26 that may be constituted from a primable cell battery or by one or more capacitors charged before firing. The electrical initiator **18*a* is connected on one end to the source of energy 26 and on another end to the contact 24*a*** of the firing mode selector.

The electroplated parts **15*b* of the cone contact and 19*b* of the internal contact are connected in parallel to the source of energy 26**.

The conducting cap **15*a* of the cone contact is connected to the contact 24*c* of the firing mode selector 24**.

The conducting cap **19*a* of the internal contactor is connected to the contact 24*b* of the firing mode selector 24 via a first electronic delay 27** (which may be omitted according to the structure of the projectile and as will be explained hereafter).

A second electronic delay 28 is arranged in parallel between the contacts 24*a* and 24*c* of the firing mode selector.

The projectile operates as follows.

When the firer wishes to destroy a construction (extra-protected or not), he selects the appropriate firing mode on the firing mode selector 24. Upon impact of the projectile on any possible outer protections, the cone contact 15 closes which does not cause the initiation of the charge but which initiates the delay 28.

The ballistic cone 12 is destroyed by the first impact, but the penetrator 10 is sufficiently resistant and has a profile adapted to enable it to penetrate the extra-protections (such as sand bags) without damaging the explosive charge.

When the penetrator 10 comes into contact with the cement, stone or brick construction, it self-destructs.

The shell 7 thereby comes into contact with the hard construction and the shell's base, in turn, is crushed. The explosive charge deforms and the explosive, now against the base of the shell, is also crushed against the target.

After sufficient deformation of the explosive charge, the internal contactor 19 is closed, which causes initiation of the charge.

In the case of the first embodiment of the projectile described with reference to FIG. 1, the delay 27 may be omitted, as the charge is certain to be crushed against the construction when the contactor 19 is closed.

On a construction-type target, the effect of the projectile according to the invention is in fact a combined effect that associates the formation of a shaped linear charge by the non-deformed part of the shell, and an over-pressure due to the initiation of the explosive crushed against the target ("squash head" effect). Such a combination gives a particularly effective piercing effect on cement, stone or brick constructions.

The "squash head" effect is also reinforced by employing an explosive having a substantial blast effect such as Hexal.

The delay 28 will be chosen so that it will not be able to cause initiation of the charge before the contactor 19 is crushed. The function of the delay 28 is to ensure the self-destruction of the projectile in the event that it does not encounter a hard construction likely to deform the penetrator 10. A delay of around 5 to 20 milliseconds, for example, may be chosen.

This self-destruction also enables the projectiles to be given a vulnerablizing effect against light targets such as road vehicles, light vehicles, aircraft or bunkers (that is to say light shelters made by simply stacking up materials).

Light targets do not enable the penetrator to become deformed, and this lends a piercing effect to the projectile which is initiated inside the target by the delay 28. The effectiveness of the projectile is thereby improved by the choice of an explosive having a blast effect such as Hexal, which also gives a supplementary incendiary effect.

The self-destruct mode also allows, in the event that the penetrator does not encounter any hard constructions, for the initiation of the projectile inside the extra-protection thus enabling the extra-protection to be cleared with a view to subsequent attack.

When the firer wishes to destroy an armored vehicle, he chooses the anti-armor mode on the firing mode selector 24.

On impact of the projectile on the vehicle, the cone contact 15 closes, thereby causing the instant initiation of the explosive charge at an optimum distance from the target, a distance defined in a conventional manner by the length of the cone. This optimum distance enables the shaped linear charge to develop and give the best armor-piercing performances.

The projectile according to the invention thus enables three functioning modes to be obtained by means of a two-position selector, notably: anti-armor, anti-construction, anti-light-target.

Figure 3:
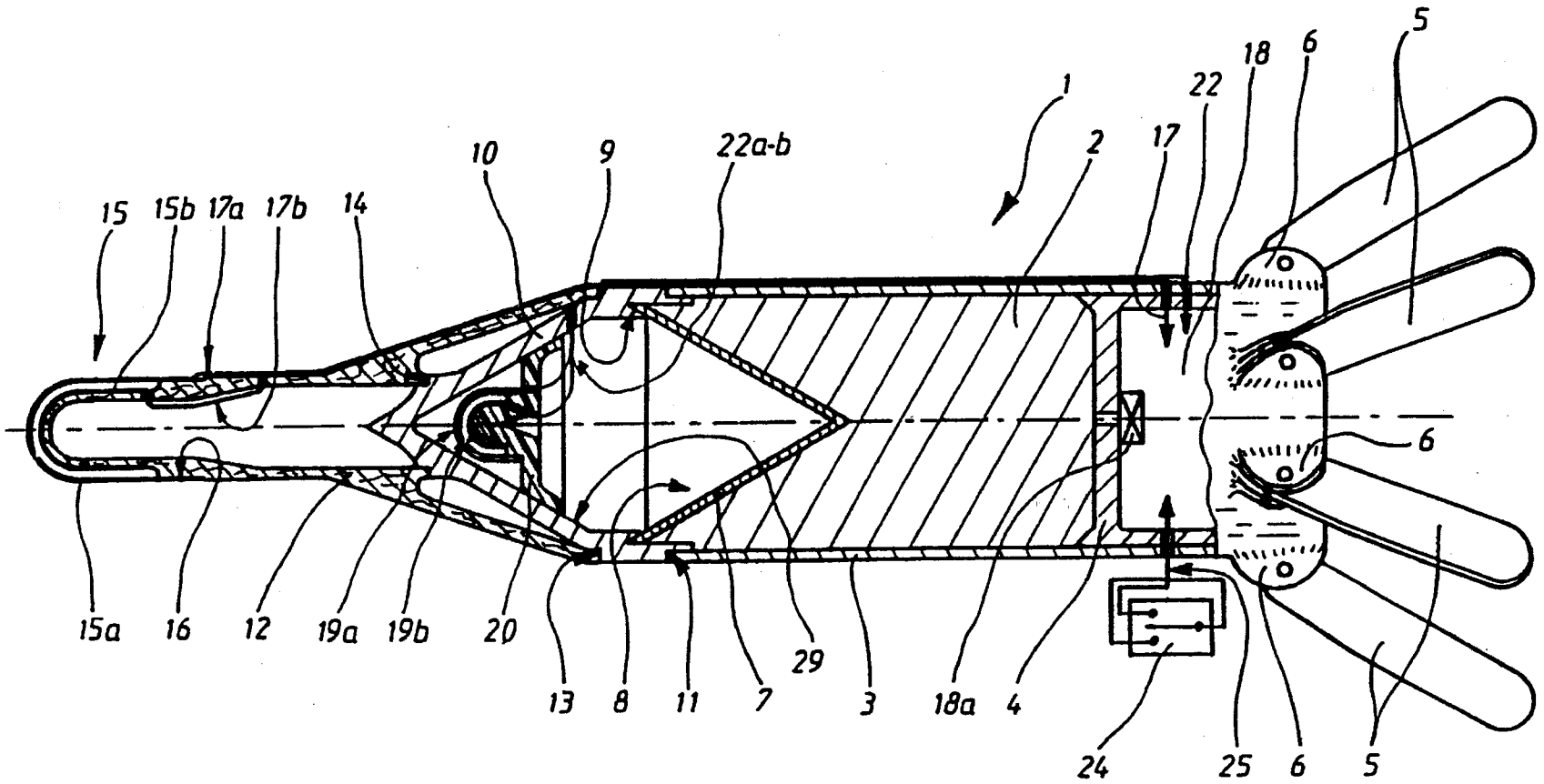
FIG. 3 shows an alternative embodiment of a projectile according to the invention in detail.

The projectile shown in FIG. 3 differs from that shown in FIG. 1 in that the position of the internal contactor 20 is different.

The internal contactor 20 is here bonded inside the inner cavity 29 of the penetrator 10. Such an arrangement enables assembly to be made easier by allowing the conductors 22*a* and 22*b* to pass outside the charge 2.

In this event it is necessary to place an electronic delay 27 (see FIG. 2) between the internal contactor 20 and the initiating means. In order to ensure that initiation, as a result of the contactor 19 being crushed, only occurs once the explosive charge has begun to be deformed after impacting on the hard construction.

Any axial position may be given to the internal contactor 20 between the bottom of the inner cavity 29 of the penetrator 10 and the bottom of the cavity 8 demarcated by the shell 7, and the delay 27 merely has to be adjusted accordingly.

Other alternatives to the invention may be envisaged.

Thus it is possible to design a projectile which does not have a nose cone contact but only an internal contact 30.

Such a projectile will be effective against constructions and will behave as described hereabove.

It will also be effective against armor but will have in this case a functioning mode identical to that for anti-construction use, that is to say through the initiation of the charge, not at an optimum distance, but after crushing the charge ("squash head" type functioning).

In this latter event, it is possible to eliminate the concave shell in contact with the explosive material.

We claim:

1. A projectile for attacking hard targets including stone, brick and cement constructions, said projectile comprising:

a shaped charge comprising a concave shell in contact with an explosive material, said concave shell defining therein a cavity;

initiating means for electrically initiating the shaped charge;

a penetrator formed in front of the shaped charge that deforms only upon impact with a target having a predetermined mechanical resistance;

an internal impact contactor arranged between the penetrator and the shaped charge; and means to ensure initiation of the shaped charge based on crushing of the internal impact contactor and after the shaped charge begins to deform following the shaped charge's impact on the target.

2. A projectile according to claim 1, wherein the internal impact contactor is located within said cavity and is only closeable once the shaped charge begins to deform after impacting the target.

3. A projectile according to claim 1, wherein the means ensuring the initiation of the shaped charge comprises a first delay activated when the internal impact contactor is crushed.

4. A projectile according to claim 1, wherein the shaped charge comprises at least one explosive material giving a reinforced blast effect when initiated.

5. A projectile according to claim 4, wherein the explosive material of the shaped charge is a mixture comprising about 70–90% Hexogen with a remaining amount of said mixture being comprised substantially of aluminum powder.

6. A projectile according to claim 1, further comprising a ballistic nose cone positioned in front of the penetrator, said nose cone having an electrical contact activated upon impact on a target, wherein said projectile further includes means for determining priority between the electrical contact and the internal impact contactor for triggering initiation of said shaped charge.

7. A projectile according to claim 6, wherein said means for determining priority comprises a firing mode selector enabling the selection of one of 1) initiation of the shaped charge based on closing of the internal impact contactor; and 2) initiation of the shaped charge based on closing of the electrical contact of the nose cone.

8. A projectile according to claim 7, wherein, when the selector is positioned to choose initiation based on contact of the nose cone, crushing of the electrical contact of the nose cone upon impact on a target causes instant initiation of the shaped charge.

9. A projectile according to claim 7, wherein, when the selector is positioned to choose initiation based on the internal impact contactor, crushing of the electrical contact of the nose cone causes initiation of the shaped charge using a delay of said initiating means.

10. A projectile for attacking hard targets including stone, brick and cement constructions, said projectile comprising:

an explosive shaped charge having a cavity therein;

an electrical initiator for initiating the shaped charge;

a penetrator in front of the shaped charge that deforms upon impact with a target having a predetermined mechanical resistance;

an internal impact contactor arranged between the penetrator and the shaped charge;

a ballistic nose cone positioned in front of the penetrator, said nose cone having an electrical contact activated upon impact on the target; and means for ensuring initiation of the shaped charge based on one of crushing of the internal impact contactor and after the shaped charge begins to deform following the shaped charge's impact on the target, and crushing of the electrical contact.

11. A projectile according to claim 10, wherein the internal contactor is placed in the cavity such that the contactor is only closeable once the shaped charge begins to deform after impacting on the target.

12. A projectile according to claim 10, further comprising a first delay activated when the internal impact contactor is crushed.

13. A projectile according to claim 10, wherein the shaped charge comprises at least one explosive material giving a reinforced blast effect when initiated.

14. A projectile according to claim 13, wherein the explosive material of the shaped charge is a mixture comprising about 70–90% Hexogen with a remaining amount of said mixture being comprised substantially of aluminum powder.

15. A projectile according to claim 10, wherein the means for ensuring initiation of the shaped charge comprises a firing mode selector enabling the selection of one of 1) initiation of the shaped charge based on closing of the internal impact contactor; and 2) initiation of the shaped charge based on closing of the electrical contact of the nose cone.

16. A projectile according to claim 15, wherein, when the selector is positioned to choose initiation based on closing the electrical contact of the nose cone, crushing of the electrical contact of the nose cone upon impact on a target causes instant initiation of the shaped charge.

17. A projectile according to claim 15, wherein, when the selector is positioned to choose initiation based on the internal impact contactor, crushing of the electrical contact of the nose cone contact causes initiation of the shaped charge using a delay of said initiating means.

18. A method for controlling detonation of a projectile for attacking hard targets including stone, brick and cement constructions, said projectile comprising an explosive shaped charge having a cavity therein, initiating means for initiating the shaped charge, the method comprising:

forming a penetrator to substantially cover a front portion of the shaped charge;

arranging an internal impact contactor between the penetrator and the shaped charge;

firing the projectile toward a target;

deforming the penetrator only upon impact with a target having a predetermined mechanical resistance; and initiating the shaped charge after the internal impact contactor impacts the target and after the shaped charge begins to deform following the shaped charge's impact on the target.

19. A method according to claim 18, wherein the projectile further comprises a nose cone and an associated electrical contact positioned in front of the penetrator, and wherein the method further comprises selecting initiation of the shaped charge depending on the type of target being targeted based on one of:

immediate initiation of the shaped charge when the electrical contact is crushed upon impact on the target; and delayed initiation of the shaped charge after the internal impact contactor is crushed and following a delay triggered once the electrical contact of the nose cone is crushed upon impact on the target.

20. A method according to claim 18, wherein the initiating step includes closing the internal impact contactor only when the shaped charge begins to deform upon impacting the target.

* * * * *